United States Patent [19]

Everson

[11] 3,940,918

[45] Mar. 2, 1976

[54] PROGRAMMER CLOCKS FOR BANKS AND LIKE INSTITUTIONS

[75] Inventor: Evan Philip Everson, Cedar Rapids, Iowa

[73] Assignee: Walter Kidde & Company, Inc., Clifton, N.J.

[22] Filed: Oct. 3, 1974

[21] Appl. No.: 511,788

[52] U.S. Cl. ..... 58/33; 58/38 R; 340/164 B

[51] Int. Cl.[2] ..... G04C 21/00; G04C 13/06

[58] Field of Search.... 58/4 A, 19 C, 33, 38, 152 B; 200/37 R, 38 D; 340/309.1, 309.2, 309.3, 309.4

[56] References Cited

UNITED STATES PATENTS

| | | | |
|---|---|---|---|
| 3,002,131 | 9/1961 | Gerosolina | 340/164 B |
| 3,025,496 | 3/1962 | Schmid et al. | 340/164 B |
| 3,603,961 | 9/1971 | Duris | 340/309.4 |

*Primary Examiner*—Edith Simmons Jackmon
*Attorney, Agent, or Firm*—Haven E. Simmons; James C. Nemmers

[57] ABSTRACT

A programmer clock for use with alarm systems in banking and like institutions employs a diode matrix, day and hour stepper switches and a direct current motor driven clock, the positions and controls of all of which are mounted and visible on a single control panel. The condition of the alarm system and the program can be determined at a glance and the program itself can be readily and accurately altered at any time by authorized persons.

3 Claims, 2 Drawing Figures

PROGRAMMER CLOCKS FOR BANKS AND LIKE INSTITUTIONS

BACKGROUND OF THE INVENTION

Programmer clocks are used in banks and similar institutions in which the alarm system protecting the vault or other areas of the bank or institution is turned off, that is, "unset", during normal business hours and then turned on again, or "set", to protect the premises during other hours, all by means of the clock. Typically, the latter have taken the form of a synchronous motor driven clock having a large face circumferentially divided into the 7 days of the week with each day being further subdivided into its 24 hours. The times of each day when the alarm system is to be set or unset is determined by a series of "pointers" clamped at appropriate locations about a rim on the face of the clock and connected into the alarm system. These clocks, however, have a number of deficiencies.

In the first place, their accuracy tends to be poor, especially when a full 7 day program is laid out on one dial, since it is difficult, if not impossible, to position the pointers exactly. For instance, if the alarm system is to be unset at 8 a.m., often the pointer will have to be adjusted back and forth several times before the alarm unsets at that hour instead of 7:45 a.m. or 8:15 a.m. Next, if a holiday intervenes during the week, then it is necessary to remove the pointers for that day in order for the alarm to remain set, whereupon they must be then replaced with all the attendant trouble to do so accurately just described. Finally, the use of synchronous clock motors, typical of the other clocks in banks, makes it difficult to provide standby power.

Accordingly, the primary object of the present invention is the provision of a programmer clock for the uses described which offers quick, accurate programming, can easily be programmed at any time and readily accommodate holidays, and is adapted to conventional standby power supplies.

SUMMARY OF THE INVENTION

The heart of the present invention lies in a diode type matrix and an ordinary direct current clock arranged together with their associated controls on a single panel so that the program of the clock can be accurately and quickly established or changed and its condition at any time determined at a glance. The face of the clock is divorced from any part of the program so that not only is it more easily read but provides a quick check of the positions of day and hour stepper switches which are also located on the panel. The program is visibly set in the matrix alone, apart from the clock, so that it, too, can be quickly checked. The use of a diode matrix not only allows the program to be rapidly and accurately set, by means of pins, but altered with equal facility, and provides great flexibility to accomodate holidays. The entire device is contained in a small, neat housing which includes a rechargeable battery and a trickle charger for standby power purposes. Other and further features and advantages of the present invention will become apparent from the more detailed description which follows and the drawings.

DESCRIPTION OF THE PREFERRED EMBODIMENT

Figure 1:
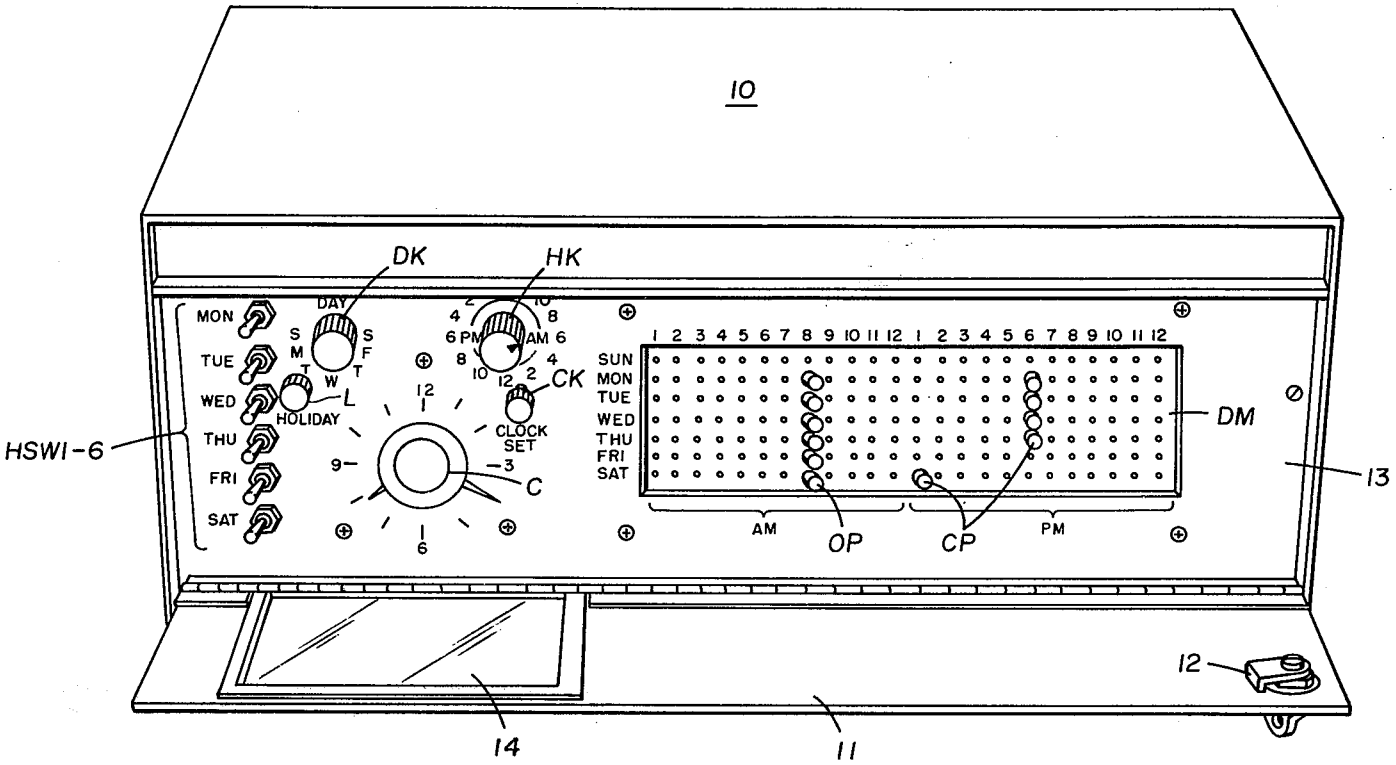
FIG. 1 is a front perspective view of the housing of the programmer clock of the prsent invention shown with its front cover open to illustrate the appearance of the control panel and the functions present on it.
Figure 2:
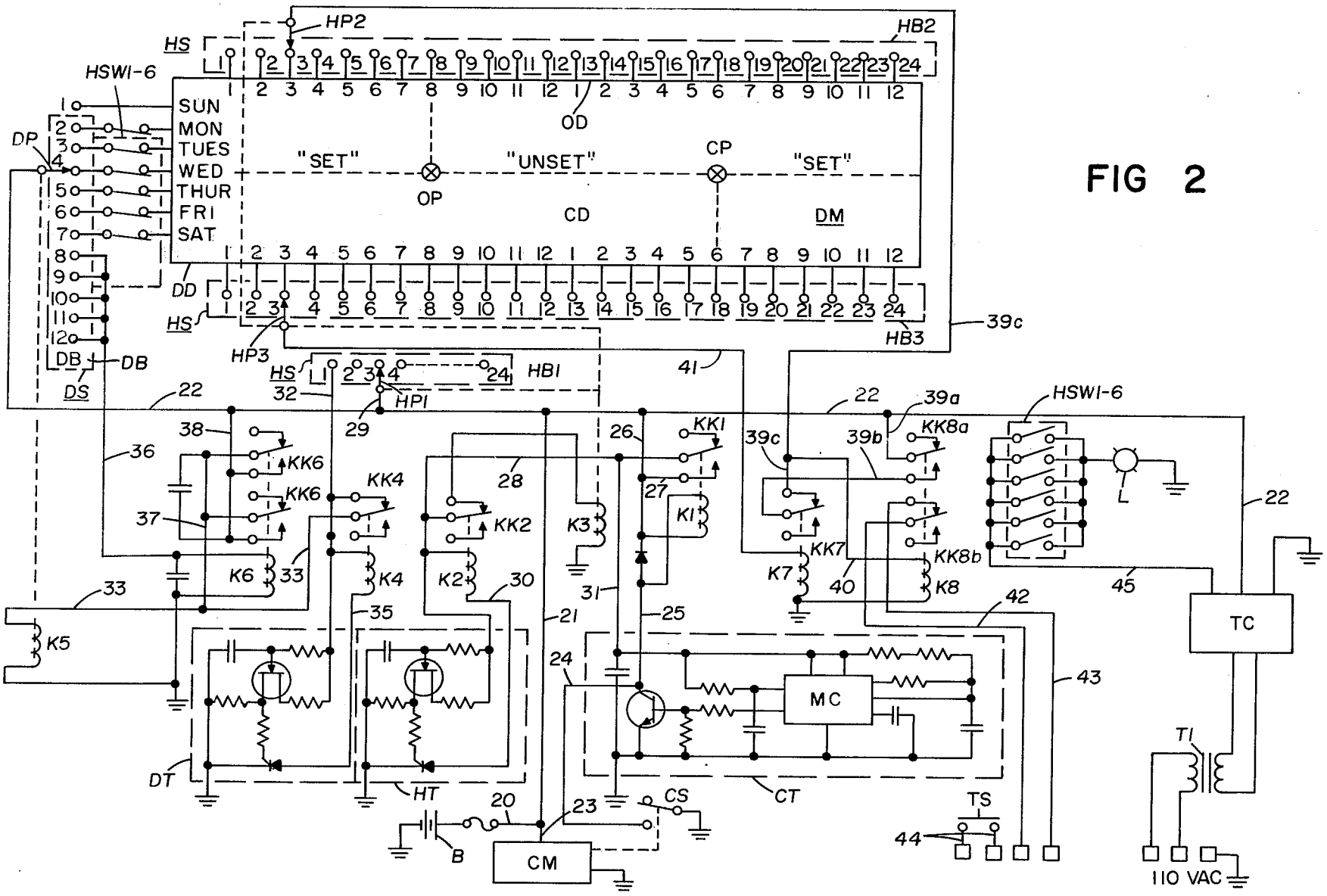
FIG. 2 is a schematic of the electrical circuitry within the housing shown in FIG. 1.

The programmer clock, as shown in FIG. 1, is encased by a rectangular metal housing 10 having a hinged, drop-down front cover 11 which when closed is normally locked at 12 to obscure an inner control panel 13 except its portion visible through a window 14 in the cover 11. Upon the control panel 13 are mounted the various controls involved with the circuitry shown in FIG. 2 and contained within the housing 10. Power is supplied by a rechargeable 12 volt battery B connected by lines 20 and 21 into a trunk line 22 leading at one end to a suitable trickle charger TC. The latter is connected in turn to 110 VAC power source through a transformer T1 and supplies regulated +12 volt DC power to the line 22 to maintain the battery B and to provide power for the remainder of the circuit now to be described.

A line 23 connected into the line 21 supplies the motor CM of a typical direct current electric clock C whose face and hands, together with its set knob CK, are located on the control panel 13, as shown in FIG. 1. To the hour hand drive shaft of the clock C is fixed a wiper in contact with a circuit card having 12 circumferentially spaced contacts (not shown), one for each of 12 hours, which are serially engaged by the wiper as the hour hand advances. This arrangement constitutes a rotary switch having 12 positions and is diagramatically indicated in FIG. 2 at CS. Of course, some other arrangement having an equivalent function could serve just as well, or a digital clock could be substituted and its pulses used instead of a switch C.S. In any event, the clock switch CS closes a circuit to ground through a line 24 to a clock timer CT which "smooths" out the circuit closing of the clock switch CS at each hour. The timer CT incorporates a typical monolithic timing circuit, indicated at MC, of a well-known type readily available on the market from various sources. Owing to the width of the contacts in the clock switch CS, the circuit to the timer CT is closed for approximately 20 minutes after each hour and during that time the output of the latter through a line 25 energizes a relay K1 connected by a line 26 into the trunk line 22. The normally open contacts KK1 of the relay K1 through lines 27 and 28 in turn activate an hour timer HT and, through the normally closed contacts KK2 of a driver relay K2, the solenoid K3 of a three-pole HP1-3, three-bank HB1-3 hour stepper switch HS whose pole HP1 is connected by a line 29 into the trunk line 22. After approximately 2 seconds, the timer HT activates the driver relay K2 through a line 30 to open its contacts KK2 and deactivate the solenoid K3 of the hour stepper switch HS. In the meantime, since the clock switch CS remains closed for 20 minutes, the timer CT maintains the relay K1 energized during that period until the clock switch CS opens to deactivate the timer CT and the relay K1 and open its contacts KK1. At the same time, the timer CT through a line 31 and line 28 resets the hour timer HT to drop out the relay K2 and restore the circuit just described to the condition shown in FIG. 2 until again activated by the clock switch CS at the next hour.

The bank HB1 of the hour stepper switch HS with which the pole HP1 is associated is connected, as shown, only at the "one o'clock" position by a line 32 to one of a pair of normally closed contacts KK4 of a relay K4, then to the solenoid of the latter, and finally to a day timer DT, similar to the hour timer HT. Since only the one o'clock position of the hour stepper switch bank HB1 is used, only at that time is power applied through the lines 29 and 32 to the day timer DT and through the contacts KK4 and a line 33 to the solenoid K5 of a single-pole, single-bank, 12 position day stepper switch DS whose pole DP is connected to the other end of the trunk line 22. After a two second interval the timer DT energizes the relay K4 through a line 35, thus opening its contacts KK4 and deactivating the stepper switch solenoid K5. The relay K4 remains energized for an hour until the hour stepper switch HS moves to the "two o'clock" position, thus shutting off power through the line 32 to reset the day timer DT and deactivate the relay K4, whereby the circuit just described is returned to the condition shown in FIG. 2. The stepper switches HS and DS are also mounted on the control panel 13 and may be manually operated by knobs HK and DK as shown in FIG. 1.

Seven of the twelve positions of the single bank DB of the day stepper switch DS representing the seven days of the week are used in the manner hereafter described. The remaining five (owing to the fact that seven position stepper switches are not commercially available) are "by-passed" at the end of the seventh day by connecting them together by a line 36 to a driver relay K6 having two pairs of normally open contacts KK6 through which the line 33 to the stepper switch solenoid K5 is connected to the trunk line 22 by lines 37 and 38. Hence, when the day stepper switch DS has advanced to its eighth position, power is supplied through the line 36 to the solenoid of the driver relay K6, closing its contacts KK6 and energizing the stepper switch solenoid K5 through the lines 33, 37 and 38. The stepper switch DS continues to advance until it returns to its first or "Sunday" position, disconnecting the trunk line 22 from the line 36 and deactivating the driver relay K6 to open its contacts KK6, whereupon the stepper switch solenoid K5 is also deactivated.

The first through seventh positions of the day stepper switch bank DB, representing Sunday through Saturday, respectively, are connected as shown into the day deck DD of a diode type matrix DM, which opens through the control panel 13 as shown in FIG. 1, the connections representing the six days Monday through Saturday being through respective pairs of normally closed contacts of six double-pole, single-throw holiday switches HSW1-6, also located on the control panel 13 as shown in FIG. 1, for purposes to be later described. The remaining banks HB2 and HB3 of the hour stepper switch HS, each having 24 positions, are connected respectively to an "open deck" OD and a "close deck" CD of the matrix DM with which the remaining two poles HP2 and HP3 of the stepper switch HS are also respectively associated. The pole HP2 is connected by lines 39*a*, 39*b* and 39*c* to the trunk line 22 through the normally closed contacts KK7 of a close alarm relay K7 and a pair of normally open contacts KK8*a* of an open alarm relay K8, and by a line 40 to the solenoid of the latter relay. The pole HP3 in turn is connected by a line 41 directly to the solenoid of the relay K7. A pair of normally closed contacts KK8*b* of the relay K8 are connected by lines 42 and 43 to the output of the programmer clock which in turn sets and unsets the alarm system (not shown) in the manner to be described. Also connected into the alarm system through lines 44 is a tamper switch TS associated with the housing 10. The remaining pairs of normally open contacts of the holiday switches HSW1-6 are connected in parallel with a line 45 from the charger TC and in series with a signal lamp L on the control panel 13. The face and hands of the clock C, its set knob CK, the manual control knobs HK and DK for the stepper switches HS and DS and the lamp L are visible through the window 14 when the cover 11 is closed and locked.

The diode matrix DM, as is well known, is operated by two sets of "open" and "close" pins OP and CP of different lengths, each containing a diode through which connection is made between the day deck DD on the one hand and the open and close decks OD and CD on the other hand. When the alarm is set, the relay contacts KK7, KK8*a* and KK8*b* are in the positions shown in FIG. 2 and in the absence of any pins OP and CP in the matrix DM the alarm will remain set. Suppose it is desired to unset the alarm each week day including Saturday at 8 a.m. and reset it at 6 p.m. Monday through Friday and at 1 p.m. on Saturday. Open and close pins OP and CP are therefore placed in the matrix DM in the appropriate locations as shown in FIG. 1. The clock C advances the hour stepper switch HS and the latter the day stepper switch DS in the manner previously described. Taking Wednesday as an example (see FIG. 2), when the pole DP of the day stepper switch DS arrives at the Wednesday position and the pole HP2 of the hour stepper switch HS at the 8 a.m. position, power from the trunk line 22 is applied through the open pin OP at the 8 a.m. Wednesday position and the lines 39*c* and 40 to the solenoid of the open alarm relay K8, opening its contacts KK8*b*. The alarm circuit through the lines 42 and 43 is thus opened while the closing of the contacts KK8*a* establishes a holding circuit through the lines 39*a*, 39*b*, the contacts KK7 of the relay K7, and the lines 39*c* and 40 for the solenoid of the open relay K8. Hence the alarm circuit remains unset until the pole HP3 arrives at the 6 p.m. position whereupon power from the trunk line 22 is applied through the close pin CP at the 6 p.m. Wednesday position and the line 41 to the solenoid of the close relay K7, thus opening its contacts KK7 to drop out the holding circuit for the relay K8 and reset the alarm circuit through the contacts KK8*b*. Sunday, of course, normally has no pins OP or CP at all so that the alarm remains set throughout that day. Should Wednesday or any other weekday be a holiday, its respective holiday switch HSW1-6 is activated, by-passing the effect of the pins OP and CP for that day and thereby keeping the alarm circuit set without need to disturb its pins OP and CP. The signal lamp L is also lit at the same time to warn that the normal program of the matrix DM has been shunted for 1 (or more) days. Obviously any adjustment of the hours of any day in which the alarm circuit is to be set or unset is readily and accurately accomplished simply by manipulating the pins OP and CP. Daylight savings time is easily accommodated by the clock set knob CK and the knobs DK and HK for advancing or retarding the stepper switches HS and DS on the control panel 13. Observe that the condition of the programmer clock at any time and its entire program is quickly available upon a glance at the control panel 13. Other details of the circuitry of FIG. 2 and its fabrication will be apparent to those skilled in the art.

Though the present invention has been described in terms of a particular embodiment, being the best mode known of carrying out the invention, it is not limited to that embodiment alone. Instead, the following claims are to be read as encompassing all adaptations and modifications of the invention falling within its spirit and scope.

I claim:

1. A programmer clock for the alarm systems of banking and like institutions comprising: an electrically powered clock having a face providing visual indication of the time of day; hour and day stepper switches, the hour stepper switch having successive positions indicative of the 24 hours of each day and electrically associated with the clock effective so that it is activated by the clock and serially advanced upon each hour of the day signalled by the clock, the day stepper switch having successive positions indicative of the seven days of each week and electrically associated with the hour stepper switch effective so that the day stepper switch is activated by the hour stepper switch and serially advanced after the end of each day signalled by the hour stepper switch, each of said switches having means for optionally and independently manually advancing or retarding the same; a diode matrix having first, second and third decks, the first deck having successive locations respectively electrically connected in series with said positions of the day stepper switch, the second and third decks each having successive locations respectively electrically each connected in series with said positions of the hour stepper switch, the matrix having means for electrically interconnecting selected locations of the first deck to selected locations of each of the second and third decks to provide an output effective to control an alarm system; holiday switches respectively interposed between said positions of the day stepper switch and said locations of the first deck effective to permit selected ones of said switch positions to be electrically disconnected from their respective ones of said deck locations; and signal means activated when any of the holiday switches provide said disconnection; the clock face, the manual means for the day and hour stepper switches, said deck locations of the matrix, the interconnecting means, the holiday switches and the signal means being all desposed upon a panel for visual observation thereof.

2. The programmer clock of claim 1 including a first electrical timing circuit interposed between the clock and the hour stepper switch effective to deactivate the latter switch independently of the clock after each advancement thereof by the clock, and a second electrical timing circuit interposed between the hour stepper switch and the day stepper switch effective to deactivate the latter switch independently of the hour stepper switch after each advancement of the day stepper switch by the hour stepper.

3. The programmer clock of claim 2 including a rechargeable battery supplying electrical power for the programmer clock and a trickle charger for maintaining the battery.

* * * * *